US006203453B1

(12) United States Patent
Coddens

(10) Patent No.: US 6,203,453 B1
(45) Date of Patent: Mar. 20, 2001

(54) BASKETBALL TRAINING DEVICE

(76) Inventor: Donald L. Coddens, 60189 Fellows, South Bend, IN (US) 46614

( * ) Notice: Subject to any disclaimer, the term of this patent is extended or adjusted under 35 U.S.C. 154(b) by 0 days.

(21) Appl. No.: 09/175,801

(22) Filed: Oct. 20, 1998

(51) Int. Cl.[7] ..... A63B 69/00
(52) U.S. Cl. ..... 473/450
(58) Field of Search ..... 473/450, 458, 473/464, 276, 212; 602/20–30

(56) References Cited

U.S. PATENT DOCUMENTS 1,655,082 * 1/1928 Davis .
4,881,275 * 11/1989 Cazares .
4,911,728 * 3/1990 Rigel .
5,135,217 * 8/1992 Swain .
5,228,682 * 7/1993 Wolf .
5,320,342 * 6/1994 Houck .
5,348,292 * 9/1994 Norman .
5,403,268 * 4/1995 Clement .
5,544,877 * 8/1996 Brownell .
5,816,952 * 10/1998 Blevins .
5,865,695 * 2/1999 Mahala .
5,938,548 * 8/1999 Upshaw .

OTHER PUBLICATIONS

1998 Eastbay athletics products catalog No. 0498, cover page and p. 27.
1998 Korney Board Aids, Inc. basketball mail order catalog, cover page and pp. 10–15, 17, and 19–20.

* cited by examiner

*Primary Examiner*—Sebastiano Passaniti
(74) *Attorney, Agent, or Firm*—Barnes & Thornburg

(57) ABSTRACT

A basketball training device includes a variety of straps and loops for controlling and training a user's shooting form. One embodiment of the invention generally includes a strap encircling the user's body, a pair of loops encircling the user's fingers and a second strap connecting the loops to the first strap. Another embodiment includes a first strap encircling the user's body, a second strap encircling the user's wrist, and a third strap encircling a portion of the user'arm. A restraint runs through a guide on the second strap and is connected to the first and third straps. In another embodiment, a substantially rigid plate is secured to the arm of the nondominant hand of the user to limit its travel and reduce the possibility of thumbing. The embodiments may be used in combination.

20 Claims, 7 Drawing Sheets

BASKETBALL TRAINING DEVICE

BACKGROUND AND SUMMARY OF THE INVENTION

The present invention relates to athletic equipment and, in particular, to a training device for basketball players.

Some basketball coaches believe that shooting a basketball with a particular form results in greater accuracy. Various training devices have been developed to correct what some believe are bad shooting habits and to otherwise teach proper shooting form.

"Thumbing" is one habit identified by some coaches as contributing to bad shooting form. Thumbing occurs when the shooter raises the ball with both his dominant and nondominant hands and pushes the ball with the thumb of his non-dominant hand as he releases the shot. This is sometimes done with a flicking motion, which can put an undesirable spin on the ball.

Some coaches have also identified the "flying elbow" as a bad habit. A flying elbow occurs when the shooter brings the ball over his head and shoots with the elbow of his dominant hand pointing outward away from his body. Some coaches believe this reduces the accuracy of the shot.

The present invention provides a basketball training device to help reduce the incidence of thumbing. The present invention also provides a basketball training device to help reduce the incidence of flying elbows. The device may be used to reduce thumbing and flying elbows at the same time or individually.

In one embodiment of the present invention a basketball training device includes a strap having first and second loops connected to it. The strap may be configured to encircle a portion of the users body and may be adjustable. A buckle may be connected to the strap. One or more of the loops may be made from an elastic material.

In another embodiment, a second strap is connected to the strap and to one or more of the loops. The second strap may be made from elastic material and may be adjustable. The second strap may be connected to the loops by a buckle.

In another embodiment of the invention, a basketball training device includes a first strap, a second strap, a third strap and a restraint connected to the first and second straps. The first strap may include a connector, which may be in the form of a ring. The restraint may be connected to the connector. The restraint may also include a connector, which may be in the form of a clasp. The connector on the strap may be connected to the connector on the restraint. The restraint may include a cord and may be detachable from the first strap. The restraint may also be connected to the second strap. The third strap may include a guide through which the restraint extends.

In another embodiment, a basketball training device according to the present invention includes first, second and third straps for encircling portions of a user's body. First and second loops are provided for encircling the user's fingers. A fourth strap connects the first and second loops to the first strap. A first connector is connected to the first strap and a second connector is connected to the second strap. A guide is connected to the third strap. A restraint extends through the guide and is connected to the first and second connectors.

In another embodiment, a basketball training device includes at least one strap for encircling a portion of a user's body and at least one loop connected to the strap for encircling at least one of the user's fingers.

Other aspects of the present invention will be apparent to those of ordinary skill in the art from the following detailed description of the preferred embodiments and the accompanying drawings.

DETAILED DESCRIPTION OF THE PREFERRED EMBODIMENTS

Figure 1:
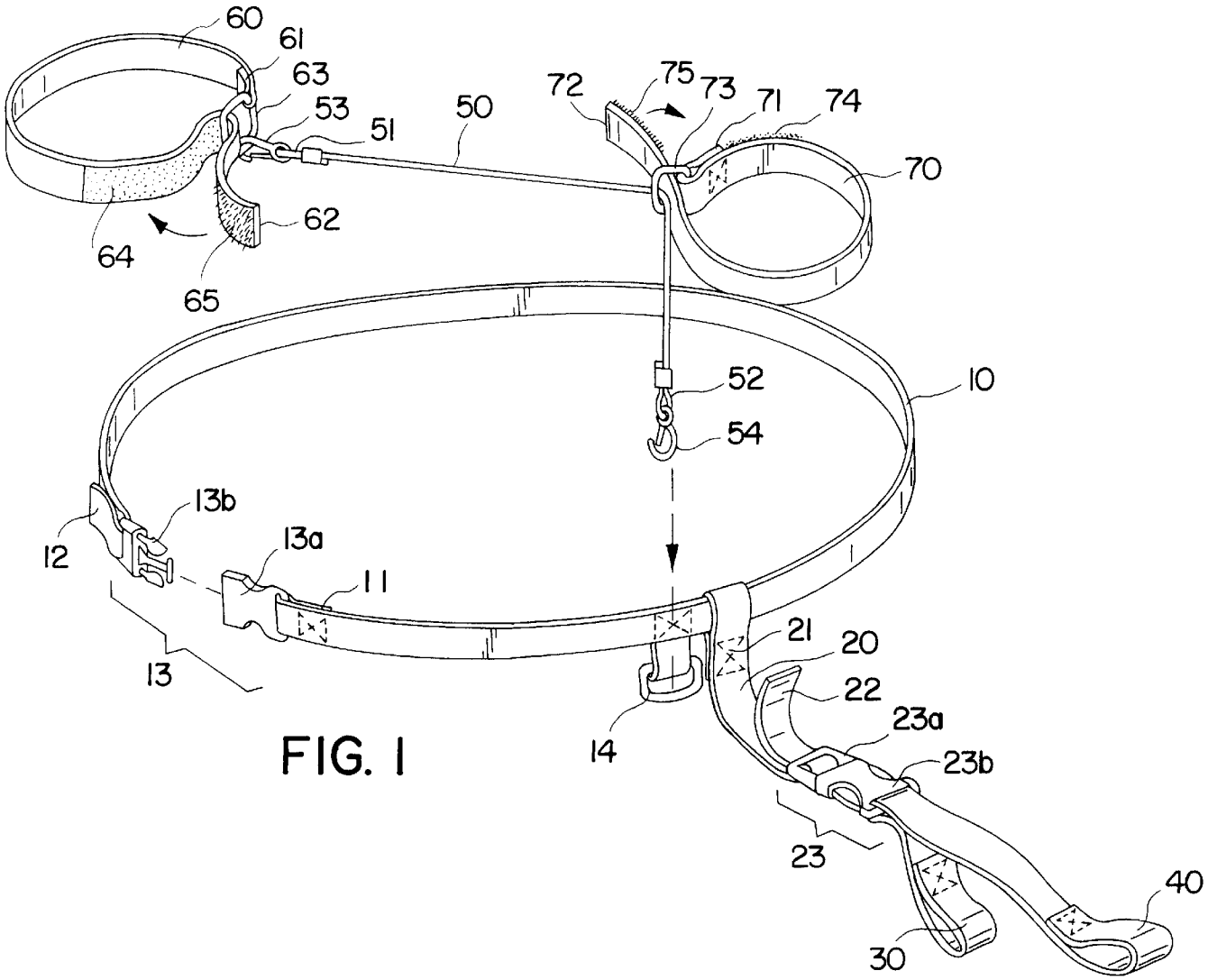
FIG. 1 is a perspective view of one embodiment of a basketball training device according to the present invention.

FIG. 1 shows a perspective view of a basketball training device according to the present invention. Generally speaking, the training device, in the embodiment shown, includes a first strap 10, a second strap 20, a first loop 30, a second loop 40, a restraint 50, a third strap 60 and a fourth strap 70.

First strap 10 is preferably made from a woven nylon or similar material. However, various other materials, such as elastics or leather, could likewise be used. First strap 10 includes a first end 11 and a second end 12. In the embodiment shown, first strap 10 is provided with a buckle 13. First portion 13*a* of buckle 13 is connected to first end 11 of strap 10. Second portion 13*b* of buckle 13 is connected to second end 12 of first strap 10 so as to be adjustable. Buckle 13 is used to secure first strap 10 around the user's body, as described below. First strap 10 further includes a connector 14 for securing one end of restraint 50 thereto. In the embodiment shown, connector 14 is a ring. However, various other connectors, such as snaps or hook and loop type fastener, could likewise be utilized.

Second strap 20, in the embodiment shown, is made from an elastic material and includes a first end 21 and a second end 22. First end 21 is connected to first strap 10. In the embodiment shown, this is done by stitching first end 21 to first strap 10. However, various attachment means, such as hook and loop type fastener, snaps, or other devices could be utilized. Note that although strap 20 is shown extending straight down from strap 10, it could be attached at any angle and could even be attached so as to extend parallel to strap 10 for some distance. A buckle 23 is provided to secure second strap 20 to first loop 30 and second loop 40. A first portion 23*a* of buckle 23 is connected to second strap 20. Note that although second strap 20 is made from an elastic material in the embodiment shown, other materials, such as nylon or leather, could likewise be used.

First loop 30 and second loop 40 are connected to second portion 23*b* of buckle 23. Loops 30 and 40 are, in the embodiment shown, made form the same elastic material as second strap 20. However, first loop 30 and second loop 40 could be made from other materials, such as nylon or leather.

It is also not necessary that first loop 30 and second loop 40 be made from the same material, or that either be made from the same material as second strap 20.

Restraint 50, in the embodiment shown, is a rope or cord having a first end 51 and a second end 52. Note that restraint 50 could be made from other suitable materials. A first connector 53 is secure to first end 51. A second connector 54 is connected to second end 52. In the embodiment shown, connectors 53 and 54 are clasps. However, as with the other connectors of the invention, they could be snaps, hook and loop fasteners or other suitable devices. Connectors 53 and 54 are used to secure restraint 50 to first strap 10 and third strap 60 as described below.

Third strap 60 includes a first end 61 and a second end 62. First end 61 includes a combined connector and guide 63 in the form of a ring. One end of restraint 50 may be connected to combined connector and guide 63 as described below. Combined connector and guide 63 can be a device other than a ring. Additionally, combined connector and guide 63 can be separated into an individual connector and an individual guide. For example, two rings could be used—one as a guide and one as a connector. Third strap 60 further includes a loop portion 64 and a hook portion 65 of hook and loop type fastener applied thereto. Loop portion 64 and hook portion 65 are used to attach third strap 60 to a user's arm. Again, loop portion 64 and hook portion 65 could be replaced with other suitable devices, such as snaps, buttons or other devices.

Fourth strap 70 includes a first end 71 and a second end 72. First end 71 includes a combined connector and guide 73 in the form of a ring. One end of restraint 50 may be connected to combined connector and guide 73 as described below. Combined connector and guide 73 can be a device other than a ring. Additionally, combined connector and guide 73 can be separated into an individual connector and an individual guide. For example, two rings could be used—one as a guide and one as a connector. Fourth strap 70 further includes a loop portion 74 and a hook portion 75 of hook and loop type fastener applied thereto. Loop portion 74 and hook portion 75 are used to attach fourth strap 70 to a user's arm. Again, loop portion 74 and hook portion 75 could be replaced with other suitable devices, such as snaps, buttons or other devices.

When the device of the present invention is used to prevent or restrict thumbing, first strap 10 is placed around a portion of the user's body. In the embodiment shown, first strap 10 is placed around the chest. However, depending on the size and configuration chosen for first strap 10, it could be placed around other body portions, such as the shoulder. This is accomplished by engaging portions 13*a* and 13*b* of buckle 13 and pulling on end 12 of first strap 10 to adjust first strap 10. Note that if first strap 10 is made from certain materials, such as elastic, buckle 11 could be eliminated, as it would not be necessary for securing first strap 10 to the user or for adjustment purposes. Rather, first strap 10 would stretch to accommodate the user's body as it is put on. Buckle 13 could also be eliminated if first strap 10 were provided with hook and loop type fastener. In such an embodiment, first strap 10 would simply be wrapped around the user's body, and the hook and loop portions of the fastener would be engaged.

The thumb and index finger of the nondominant hand are then placed in first loop 30 and second loop 40, respectively. In the embodiment shown, the length of second strap 20 can be adjusted by pulling on first end 21. In this manner, the distance of travel of the nondominant hand permitted by the device can be regulated. As an alternative, various length loops 30 and 40 could be provided connected to portions 23*b* of buckles 23. The device would then be adjusted by selecting the desired length loops and securing portions 23*a* and 23*b* of buckle 23. As yet another alternative, second strap 20 could be provided in various lengths and be connected to first strap 10 in such a manner that the lengths could be interchanged. For example, second strap 20 could be connected to first strap 10 by a buckle, snaps or hook and loop fastener. Other adjustable mechanisms are also possible.

Figure 2:
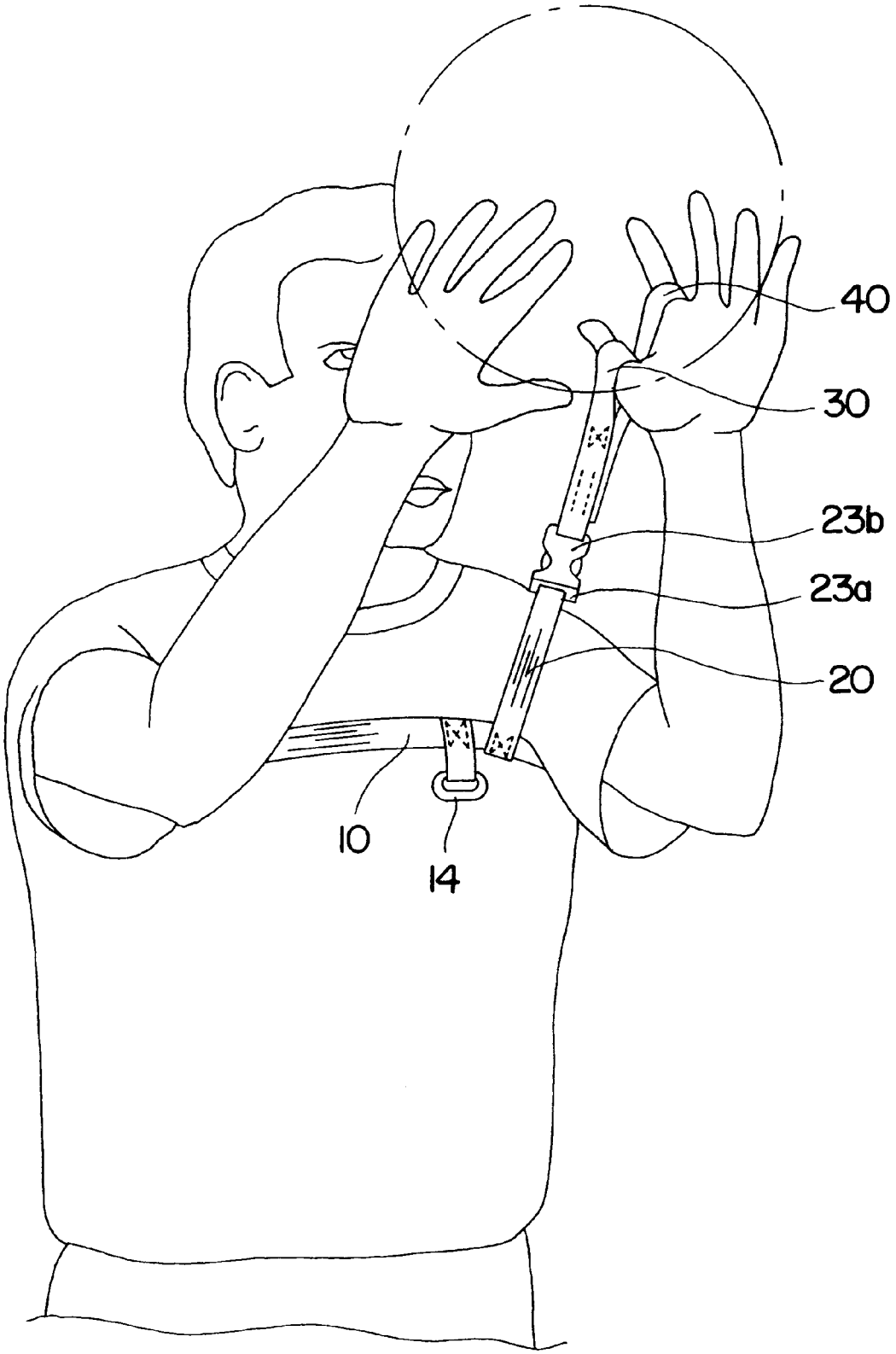
FIG. 2 is a perspective view showing the basketball training device of FIG. 1 used in a first mode before the ball has left the user's hands.
Figure 3:
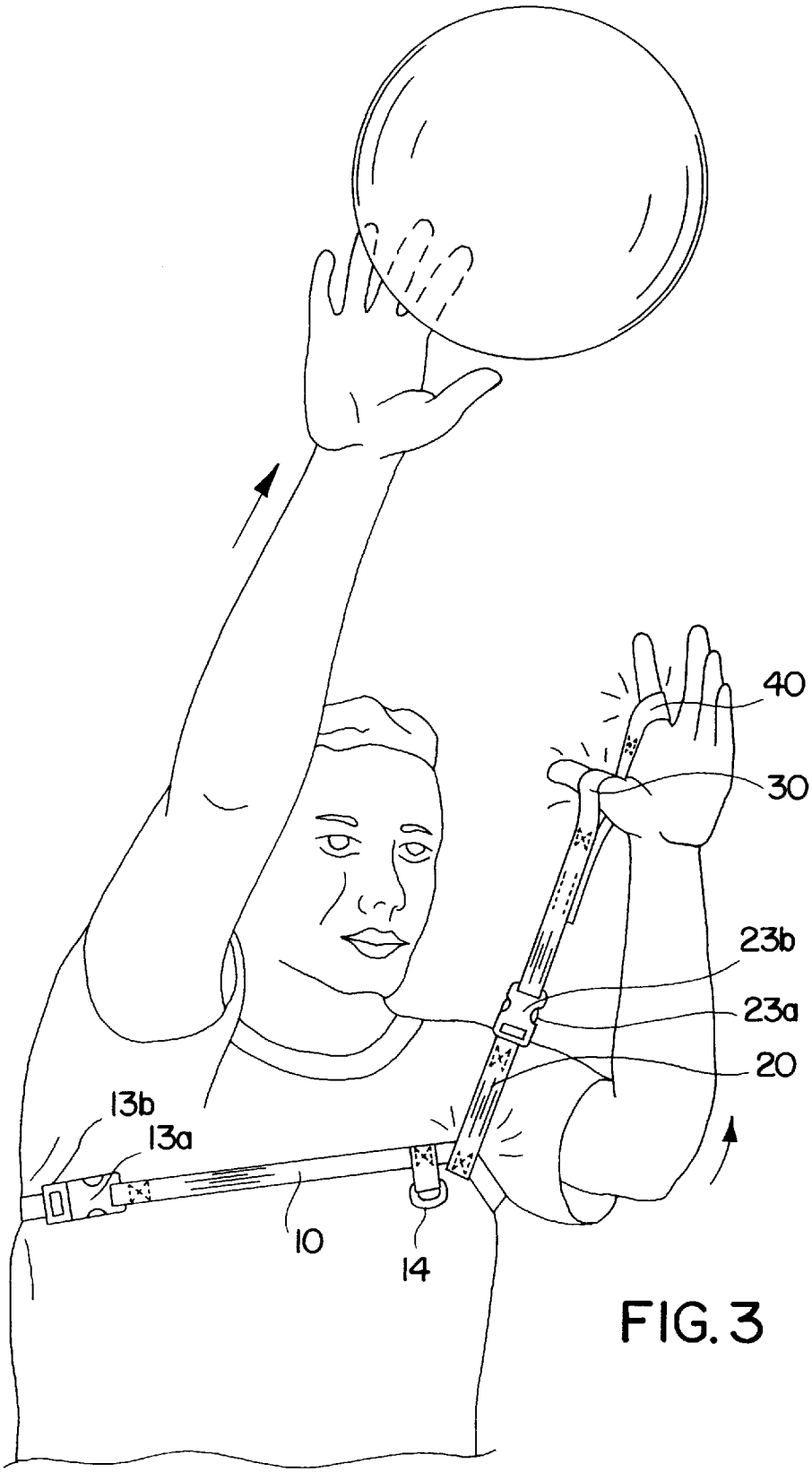
FIG. 3 is a perspective view showing the basketball training device as used in FIG. 2 after the ball has left the user's hands.

FIG. 2 shows a user holding a basketball just before shooting while wearing the device. In this position, both hands are on the ball. FIG. 3 illustrates the user after the ball has left his hands. Note that the dominant hand is fully extended. However, the nondominant hand is restrained by the device. Because the nondominant hand is not near the ball at the time of shooting, thumbing cannot occur. That is, if the thumb of the nondominant hand cannot touch the ball, it cannot impart an undesirable spin. Again, by adjusting the lengths of second strap 20, first loop 30 and/or second loop 40, and/or by controlling the materials from which these components are made, the amount of travel permitted to the nondominant hand by the device may be controlled.

Figure 4:
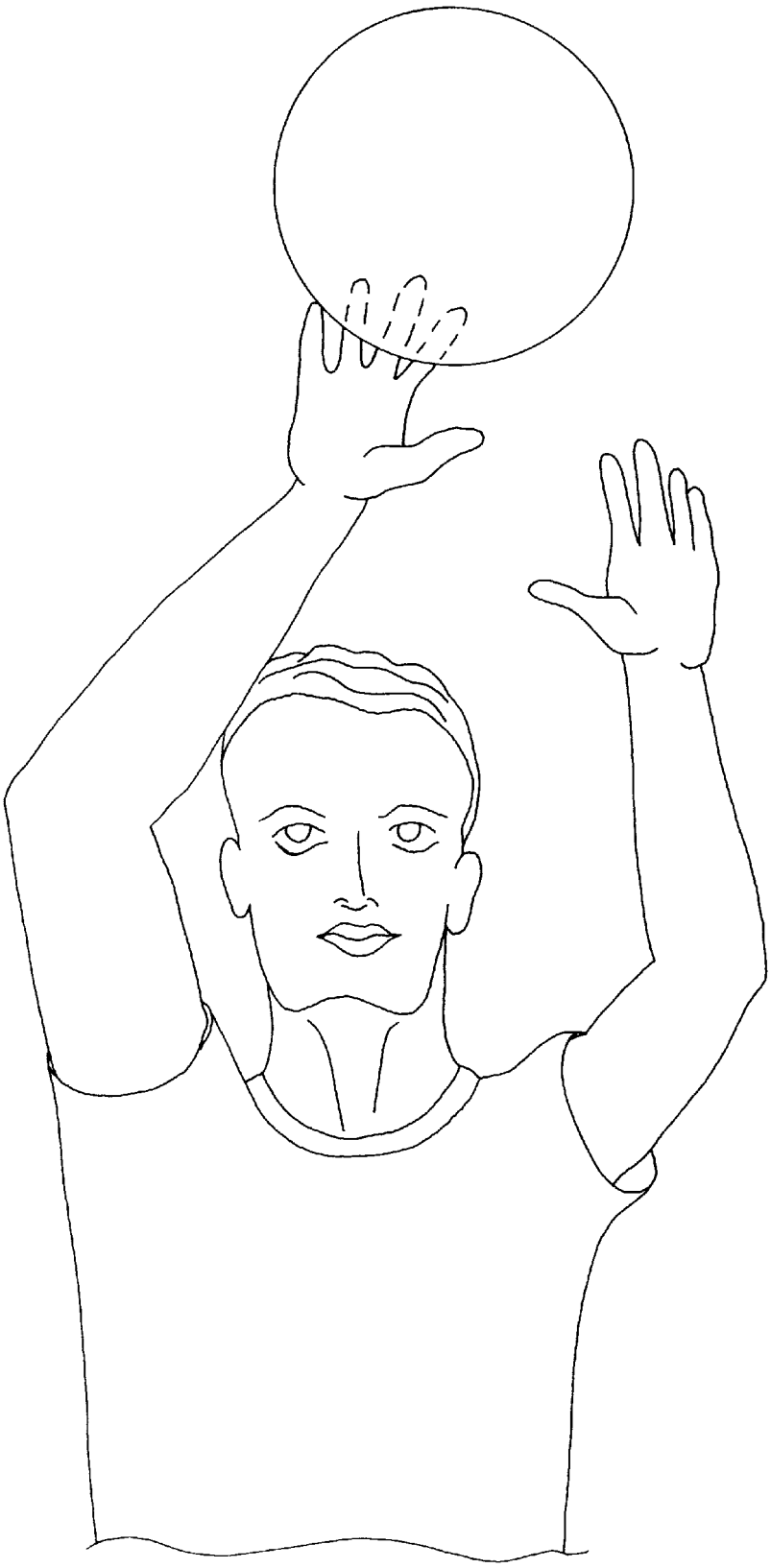
FIG. 4 is a front plan view illustrating a "flying elbow."

FIG. 4 shows a front plan view of a basketball player with a flying elbow. As can be seen, the elbow of the dominant hand, in this case the right hand, points outward away from the right side of the body. When the device is to be used to prevent flying elbows, buckle 23 may be disengaged so as to release first loop 30 and second loop 40 from the device. Alternatively, it may remain attached, as sown in FIGS. 5 and 6. Either third strap 60 or fourth strap 70 is positioned around the arm of the dominant hand. The remaining strap is secured around the wrist of the nondominant hand. In the embodiment shown, third strap 60 is secured by threading second end 62 through combined connector and guide 63 and engaging loop portion 64 with hook portion 65 of the hook and loop fastener. Fourth strap 70 is secured in a similar manner.

Figure 5:
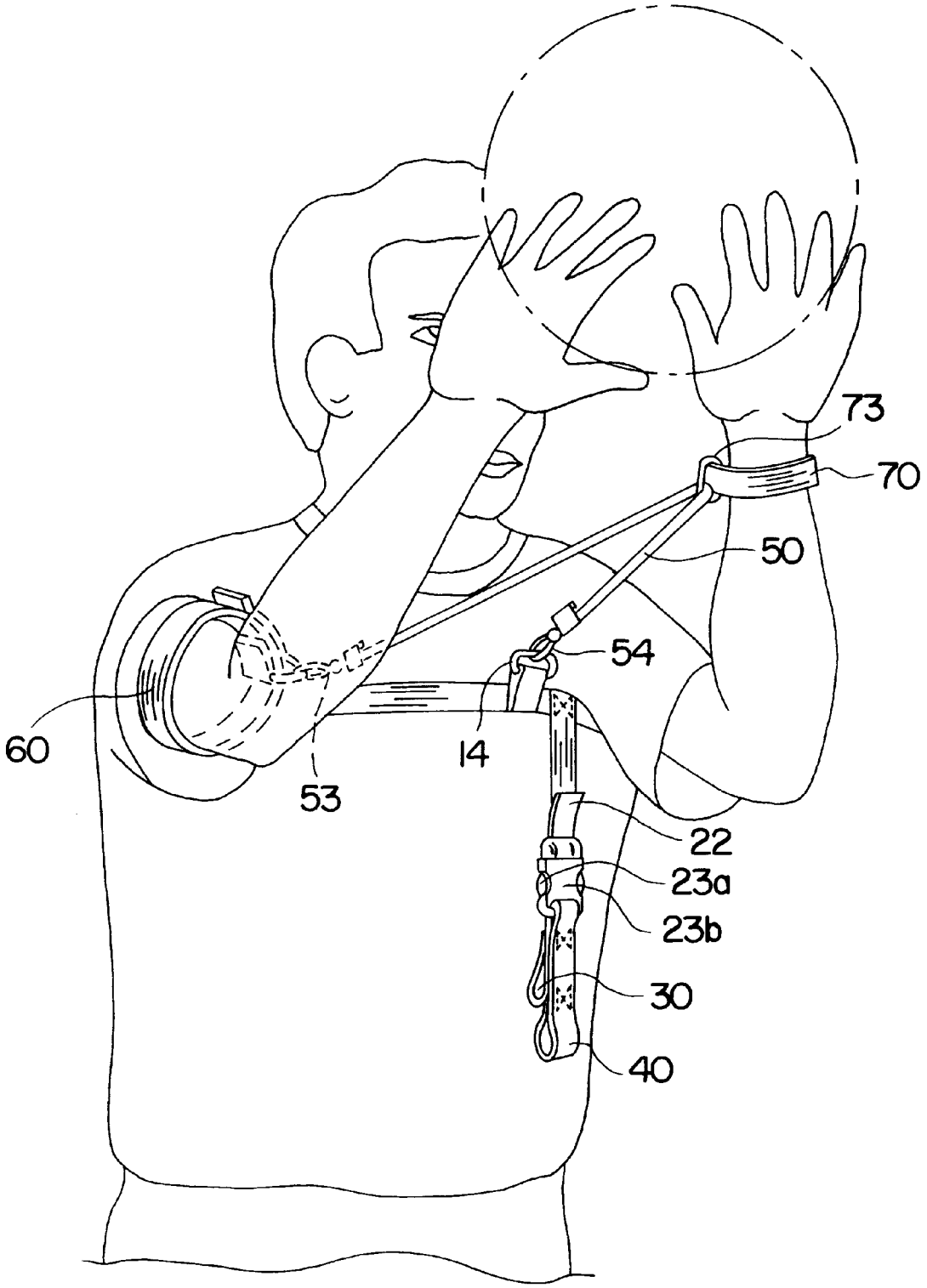
FIG. 5 a perspective view showing the basketball training device of FIG. 1 used in a second mode before the ball has left the user's hands.
Figure 6:
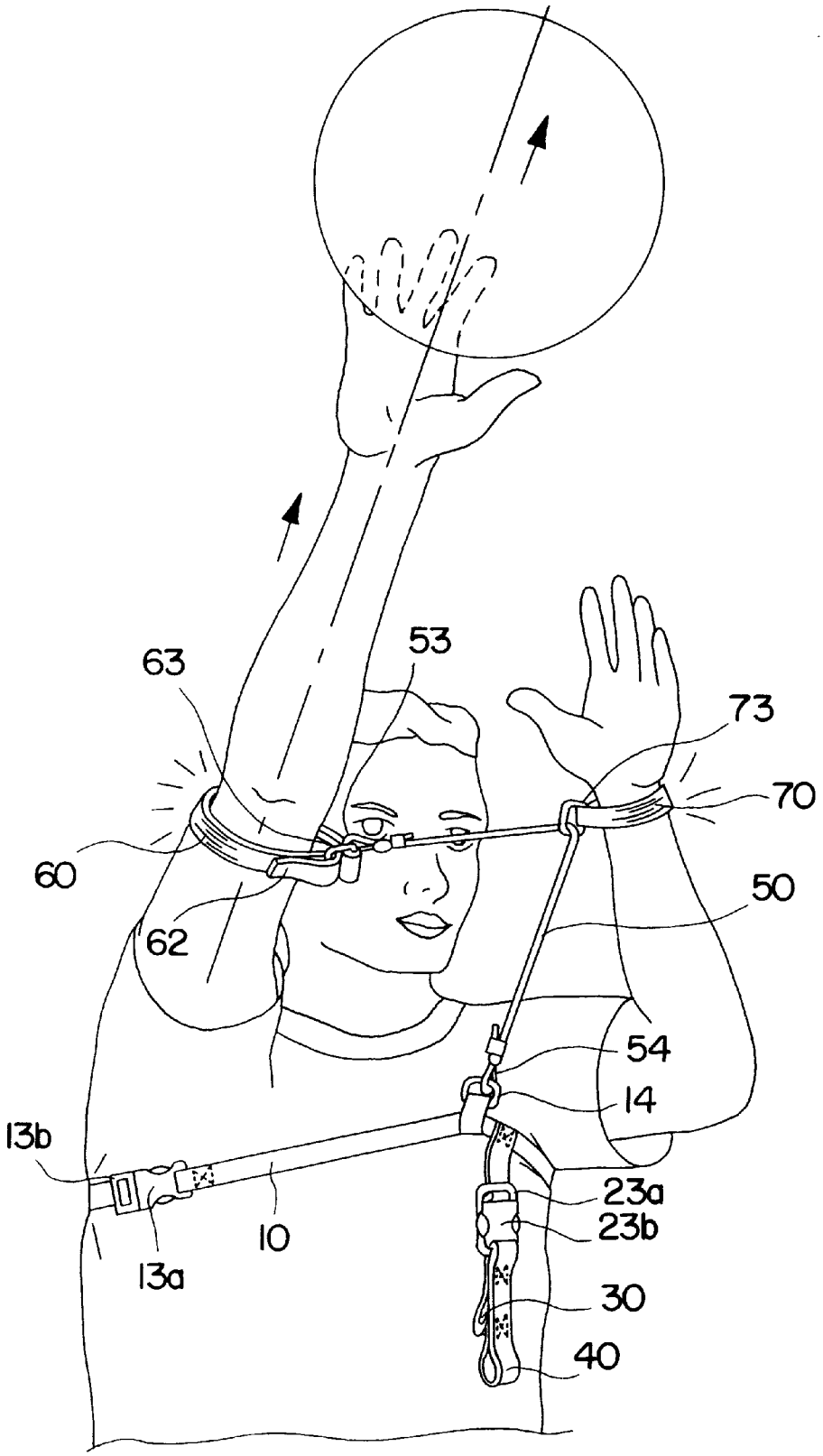
FIG. 6 is a perspective view showing the basketball training device as used in FIG. 5 after the ball has left the user's hands.

As shown in FIGS. 5 and 6, first connector 53 of restraint 50 is connected to connector 14 of first strap 10. In the embodiment shown, this is done by engaging the clasp to the ring. Second end 52 is threaded through combined connector and guide 73 of fourth strap 70 and connected to combined connector and guide 63 of third strap 60 by engaging second connector 54 with combined connector and guide 63. If fourth strap 70 were placed around the arm of the dominant hand and third strap 60 were placed around the arm of the nondominant hand, second connector 54 would be threaded through combined connector and guide 63 and connected to combined connector and guide 73.

FIG. 5 shows the user holding the ball with the device utilized in the manner just described. FIG. 6 shows the user after the ball has left his hands. As the nondominant hand moves upward, restraint 50 rides along combined connector and guide 73 and tends to pull the elbow of the dominant hand inward. As FIG. 6 shows, at the completion of the shot, the elbow of the dominant hand is pulled inwardly into the proper shooting position. Various length restraints 50 could be provided to adjust the device to different sized shooters and control the movement of the arms. The material chosen for restraint 50 will also affect movement of the arms. Note also that when the device is used to prevent flying elbows, it also tends to restrain the nondominant hand and prevent thumbing.

When the device is used as shown in FIGS. 5 and 6, combined connector and guide 63 is used as a connector while combined connector and guide 73 acts as a guide along which restraint 50 rides. If fourth strap 70 is attached to the arm of the dominant hand and third strap 60 attached to the arm of the nondominant hand, combined connector and guide 63 acts as a guide and combined connector and guide 73 is used as a connector. Note that the guide and connector functions could be separated. For example, straps 60 and/or 70 could be provided with snaps for securing them about the user without threading the strap through a ring. A separate ring or other structure could be used as a guide for restraint 50.

As an alternative to using the device in the two manners described above separately, the device can be used with both first loop 30 and second loop 40, as well as restraint 50, first strap 60 and fourth strap 70 to restrict both thumbing and flying elbows. The device as illustrated in FIGS. 2 and 3 could also be utilized to strengthen the skills of the non-dominant hand. This would be done by placing loops 30 and 40 around the finger and thumb of the dominant hand to restrain its mobility, thereby encouraging use of the non-dominant hand. For example, the device could be used in this manner to improve a user's ability to shoot lay-ups with the nondominant hand.

Figure 7:
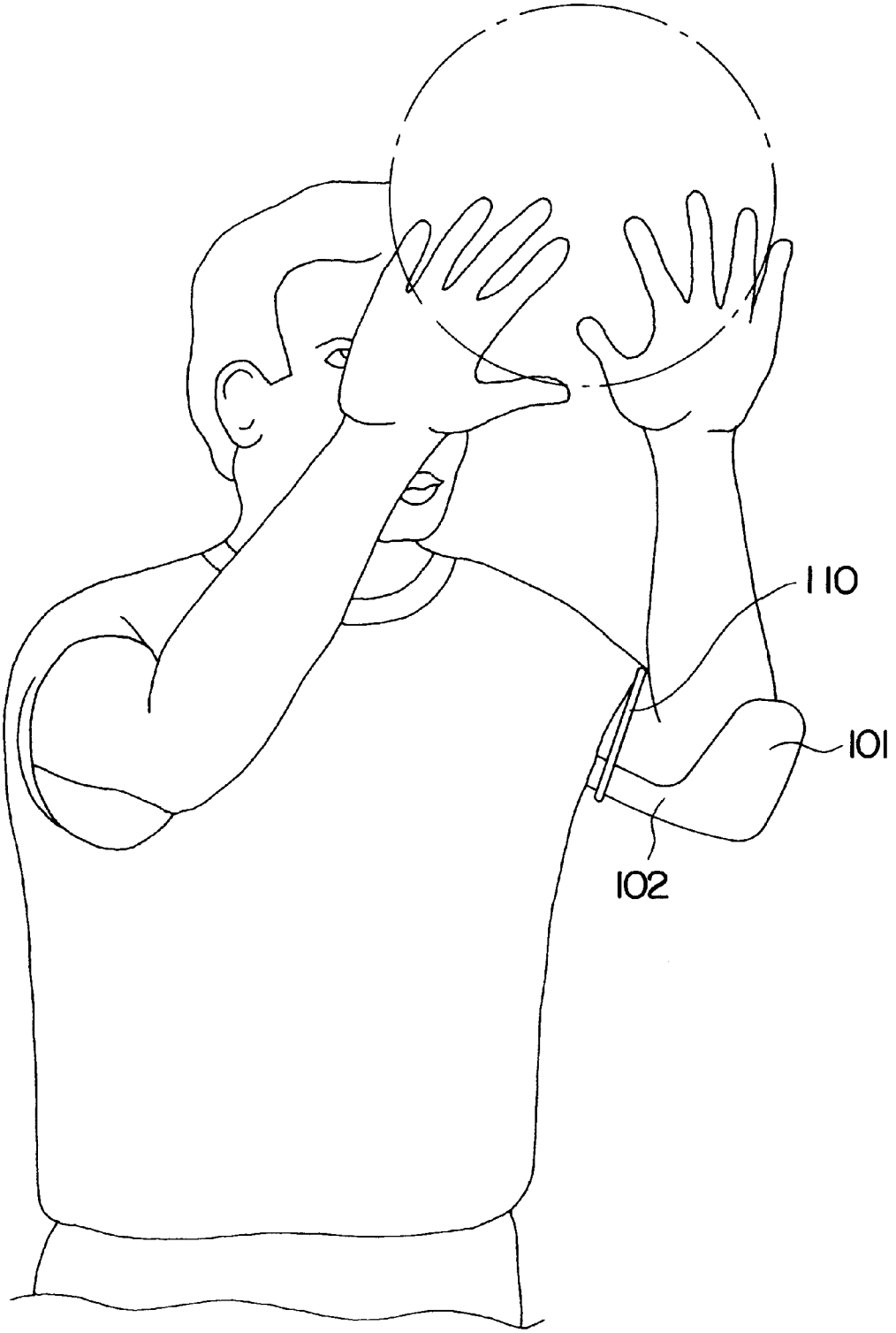
FIG. 7 shows an alternative embodiment of a basketball training device according to the present invention.

FIG. 7 shows an alternative embodiment of a basketball training device according to the present invention. In this embodiment, a substantially rigid plate 100 having a front portion 101 attached to a base 102 is secured to the non-dominant arm of the user by a strap 110. Plate 100 is angled such that, as shown in FIG. 7, the user's nondominant arm is spaced back from front portion 101 of plate 100 and not in contact therewith. As the user raises his hands to shoot, the arm of the nondominant hand is free to raise upwardly. However, if the user tries to extend the arm of the nondominant hand, as often occurs during thumbing, its travel will be limited by contact between the arm and the front portion 101 of plate 100. Thus, the nondominant hand will not be able to travel far enough to thumb the ball.

Although various embodiments of the present invention have been illustrated and described in detail, the same is by way of illustration only and does not limit the scope of the invention. Numerous changes can be made to the embodiments illustrated and described without departing from the present invention. For example, it is possible to completely eliminate strap 10 and secure either strap 20 or one end of restraint 50 directly to the user's jersey by any of a number of devices, such as clips of various kinds. It is also possible to eliminate strap 20 in its entirety and secure loops 30 and/or 40 either directly to strap 10 or directly to the user's jersey. Additionally, when the device is used to prevent thumbing, the amount of resistance to movement of the nondominant hand can also be affected and/or controlled by the material from which strap 10 is made. For example, if strap 10 is elastic, the nondominant arm would tend to pull strap 10 away from the user's body somewhat as the hand is raised for the shot. Thus, greater travel would be permitted. Accordingly, the scope of the present invention is to be limited only by the terms of the appended claims.

What is claimed is:

1. A basketball training device, comprising:

a strap configured to encircle the torso of a body;

a first loop connected to the strap and configured to engage a first finger on a hand of a non-dominant arm; and a second loop having a selectively adjustable length relative to the first loop and also being connected to the strap and configured to engage a second finger on the hand wherein an amount of travel of the hand is controlled by the length of the second loop for preventing the first finger from engaging and having an undesirable effect on a basketball.

2. A basketball training device according to claim 1, wherein the strap is adjustable.

3. A basketball training device according to claim 1, further including a buckle connected to the strap.

4. A basketball training device according to claim 1, wherein at least one of the loops is made from an elastic material.

5. A basketball training device according to claim 4, wherein the first and second loops are made from an elastic material.

6. A basketball training device according to claim 1, further including a second strap connected to the strap.

7. A basketball training device according to claim 6, wherein the second strap is made from elastic material.

8. A basketball training device according to claim 6, wherein the second strap is adjustable.

9. A basketball training device according to claim 6, wherein the second strap is connected to the strap by stitching.

10. A basketball training device according to claim 1, further including a second strap connected to at least one of the loops.

11. A basketball training device according to claim 10, wherein the second strap is connected to the first and second loops.

12. A basketball training device according to claim 10, wherein the second strap is made from elastic material.

13. A basketball training device according to claim 10, wherein the second strap is adjustable.

14. A basketball training device according to claim 10, wherein the second strap is connected to at least one of the loops by a buckle.

15. A basketball training device according to claim 1, further including a second strap connected to the strap and at least one of the loops.

16. A basketball training device according to claim 15, wherein the second strap is connected to the first and second loops.

17. A basketball training device according to claim 15, wherein the second strap is made from an elastic material.

18. A basketball training device according to claim 15, wherein the second strap is adjustable.

19. A basketball training device according to claim 15, wherein the second strap is connected to at least one of the loops by a buckle.

20. A basketball training device, comprising:

a first means for encircling the torso of a user's body;

a second means for encircling at least one of the user's fingers of a non-dominant arm;

a third means for encircling a second of the user's fingers of the non-dominant arm and being adjustable relative to the second means for preventing, the user's fingers from having an undesirable effect on a basketball; and a fourth means for connecting the second and third means to the first means.

* * * * *